US005943822A

United States Patent [19]

Slocomb et al.

[11] Patent Number: 5,943,822

[45] **Date of Patent: *Aug. 31, 1999**

[54] BALANCESHOE HAVING A RECESS FOR ACCOMMODATING A WELD FLASH OF A HOLLOW WINDOW FRAME

[75] Inventors: Colin Slocomb, Wilmington, Del.; Scott E. Beard, Lewisburg, W. Va.

[73] Assignee: CSB Enterprises, Inc., Wilmington, Del.

[ * ] Notice: This patent is subject to a terminal disclaimer.

[21] Appl. No.: 09/140,793

[22] Filed: Aug. 27, 1998

Related U.S. Application Data

[63] Continuation-in-part of application No. 08/764,997, Dec. 16, 1996, Pat. No. 5,802,767.

[51] Int. Cl.[6] ..... E05D 15/22

[52] U.S. Cl. ..... 49/181; 49/176; 49/445

[58] Field of Search ..... 49/181, 176, 445

[56] References Cited

U.S. PATENT DOCUMENTS

| | | | |
|---|---|---|---|
| 2,987,758 | 6/1961 | Osten | 49/181 X |
| 4,452,012 | 6/1984 | Deal | 49/181 |
| 4,590,708 | 5/1986 | Campodonico | 49/181 |
| 4,930,254 | 6/1990 | Valetin | 49/181 |
| 5,036,622 | 8/1991 | Stark | 49/445 |
| 5,069,001 | 12/1991 | Makarowski | 49/176 |
| 5,237,775 | 8/1993 | Hardy | 49/181 |
| 5,301,467 | 4/1994 | Schmidt et al. | 49/176 X |
| 5,802,767 | 9/1998 | Slocomb et al. | 49/181 |

*Primary Examiner*—Daniel P. Stodola
*Assistant Examiner*—Gregory J. Strimbu
*Attorney, Agent, or Firm*—Connolly & Hutz

[57] ABSTRACT

A window frame assembly made of hollow profiles where the components are welded together to form a channel or passage for a balance shoe, wherein the balance shoe is characterized by having the side walls of the balance shoe recessed so as to accommodate flash that may be encountered at the weld seam of the welded components.

8 Claims, 2 Drawing Sheets

BALANCESHOE HAVING A RECESS FOR ACCOMMODATING A WELD FLASH OF A HOLLOW WINDOW FRAME

CROSS-REFERENCE TO RELATED APPLICATION

This application is a continuation in part of application Ser. No. 08/764,997, filed Dec. 16, 1996 now U.S. Pat. No. 5,802,767.

BACKGROUND OF INVENTION

Various types of window assemblies exist including a pivotable window sash assembly which includes a tilt window sash mounted to a channeled window frame. In use, the window sash would move up and down and would also be capable of pivoting outwardly with respect to the window frame for access, for example, in cleaning the window. A conventional mechanism for accomplishing these movements is to include a balance shoe which is mounted for slidable movement in a channel in the window frame. A pivot bar is secured to the window sash and is engaged with the balance shoe. In this manner the balance shoe moves in the channel which acts as a track during the up and down movement of the window sash. In one form of balance shoe a freely mounted sleeve is included in the balance shoe with a slot in the sleeve engaged by an arm on the pivot bar. As a result, it is possible to rotate the window sash because of the pivotal connection effected by the sleeve being able to freely pivot within its balance shoe.

U.S. Pat. Nos. 4,930,254, 5,069,001 and 5,237,775 reflect various prior art approaches for mounting a pivot bar to a balance shoe and various details of pivotable window sash assemblies.

The hollow profiles in which the balance shoe is inserted are frequently made by welding various components together to make the frame. A flash is created at the welded joint. This flash can interfere with the insertion of the balance shoe into the channel of the hollow profile.

SUMMARY OF INVENTION

An object of this invention is to provide a pivotable window bar assembly which includes a balance shoe capable of being readily inserted into the hollow profile of the frame even where flash is present.

A further object of this invention is to provide such a balance shoe which could be inserted into a hollow profile whether or not there is existing flash at the joint of the frame.

In accordance with this invention the balance shoe has recessed side walls at its end which is inserted deepest into the frame so as to avoid structure on the balance shoe which would be interfered with by any existing flash. Preferably, the recessed side walls include a sloping wall at an angle conforming to the angle of the welded joint with the portion of the wall outwardly of that angle being cut away. Alternately, the recessed side walls include a straight wall extending completely across the side walls inwardly from the leading end of the leading wall.

THE DRAWINGS

DETAILED DESCRIPTION

Figure 1:
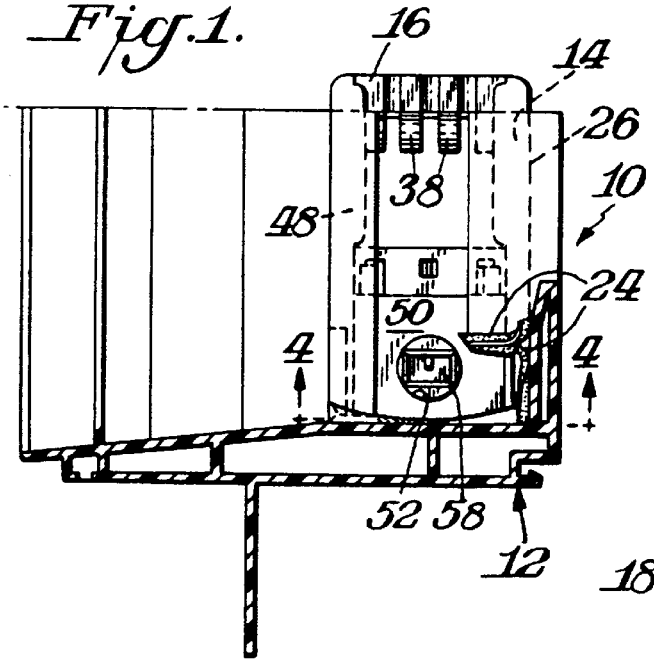
FIG. 1 is a fragmental side elevational view in cross-section of a window frame incorporating a balance shoe in accordance with this invention.
Figure 2:
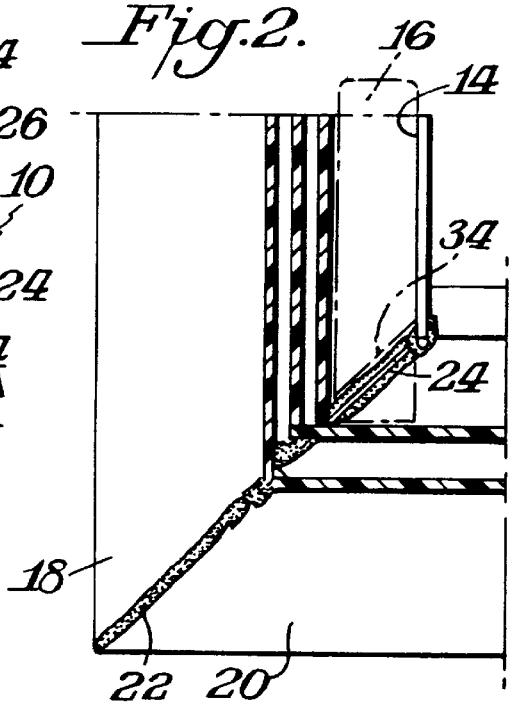
FIG. 2 is a fragmental front elevational view of the arrangement shown in FIG. 1.
Figure 5:
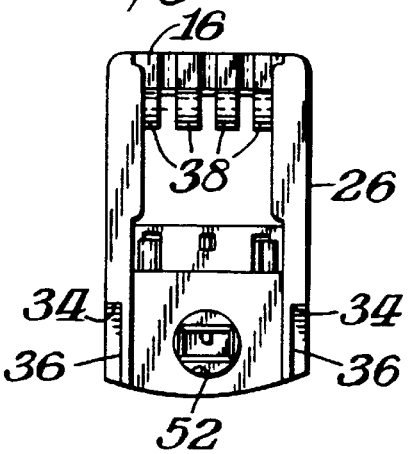
FIG. 5 is a side elevational view showing the balance shoe of this invention.

FIG. 1 illustrates a portion of a pivotable window sash assembly 10 in accordance with this invention. Most of the components of the assembly 10 may be of known construction wherein, for example, a main frame 12 is provided made of extruded PVC. Frame 12 is, for example, a master frame. A window sash (not shown) may also be an extruded PVC lift rail. Main frame 12 includes a plurality of channels. One of the channels 14 receives a balance shoe 16. As shown in FIG. 2, the main frame 12 is formed by welding together individual components 18,20 along a welded line 22 at a 45° angle to the joined edges. Frequently, such welding results in flash 24 being located at the welded seam.

In prior art arrangements the existence of such flash 24 in channel 14 causes interference with a complete sliding of the balance shoe 16 into the channel 14. It is essential that there be a proper positioning of the balance shoe so that the balance shoe may receive a pivot bar from the window sash. Such arrangements are generally known in the art as exemplified by U.S. Pat. Nos. 4,930,254; 5,069,001; and 5,237,775, the details of which are incorporated herein by reference thereto. Reference is also made to copending applications Ser. No. 641,433, filed May 1, 1996, and Ser. No. 684,082, filed Jul. 19, 1996, now U.S. Pat. No. 5,704,165 the details of which are incorporated herein and which show various forms of balance shoes and pivot bar structures. The present invention involves a modification to such balance shoes so as to accommodate the existence of the flash.

Figure 4:
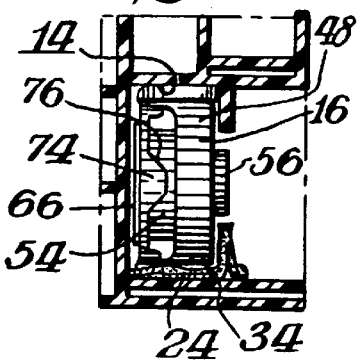
FIG. 4 is a cross-sectional view taken along the line 4—4 of FIG. 1.

As shown herein balance shoe 16 includes a U-shaped housing 48 having a wall 50 which is disposed for the pivot bar. Wall 50 includes an opening or recess 52 in which is mounted a locking member 54 in the form of a disk having a boss 56 which extends through opening 52 so that the locking member 54 may freely rotate in the housing 48. See FIGS. 1 and 4. Boss 56 includes a recess 58 having generally the same shape, but slightly larger than the pivot bar arm.

As also illustrated, balance shoe 16 includes a plate 66 mounted in the open end of the U-shaped housing 48 opposite wall 50. Plate 66 is fixedly mounted or anchored at one end centrally of housing 48 with the opposite end movable outwardly from housing 48 under the influence of rotating locking member 54. A tapered tongue 74 extends from the central portion of plate 66 for selective engagement in a correspondingly shaped notch 76 in the locking member 54.

As shown in FIG. 1 the balance shoe 16 further includes known springs 38. The balance shoe 16 slides in its track in the main frame.

Thus, in general operation the balance shoe would be used in a pivotable window sash assembly having a frame with a track therein in which the balance shoe 16 would be slidably mounted. A window sash (not shown) has a pivot bar (not shown) mounted to the pivot sash for pivotal engagement with the balance shoe to thereby connect the window sash and the balance shoe for joint movement therewith. Such general Manner of operation is described in the aforenoted patent applications.

Figure 3:
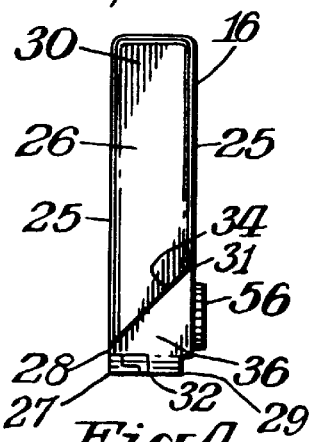
FIG. 3 is a front elevational view of the balance shoe shown in FIGS. 1 and 2.

Balance shoe 16 has a pair of outer side walls 26 which form part of the U-shaped housing. Each side wall 26 has a lead or inner end 28 and an outer end 30. The lead end 28 would be first inserted into the channel 14. In order to compensate for the possibility of flash 24 existing in channel 14 the thickness of outer wall 26 is recessed or reduced in thickness from the extreme end or front edge 32 inwardly to a beveled shoulder 34 thus leaving an indented wall section 36 of generally triangularly shape disposed inwardly of the main portion of wall 26. Thus, as shown in FIG. 3 outer or side wall 26 has a pair of opposite side edges 25, 25 which form a corner 27 and 29 at each respective junction with front edge 32. The indented wall section 36 extends substantially across side wall 26 generally from corner 27 and to location 31 inwardly from corner 29. The reduced thickness formed by the recesses permits the balance shoe 16 to be easily mounted into channel 14 even where flash 24 might exist. Accordingly, balance shoe 16 can be properly assembled in the main frame 12 for accurate engagement with the pivot bar.

Figure 6:
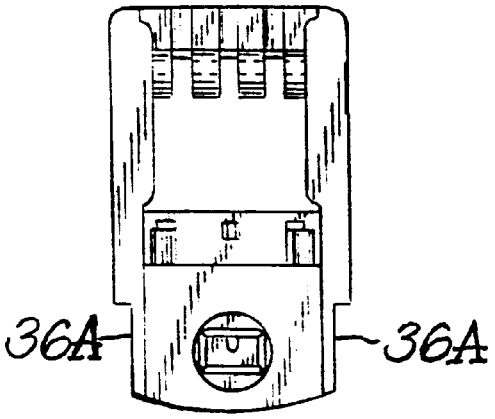
FIG. 6 is a view similar to FIG. 5 showing a modified balance shoe in accordance with this invention.
Figure 7:
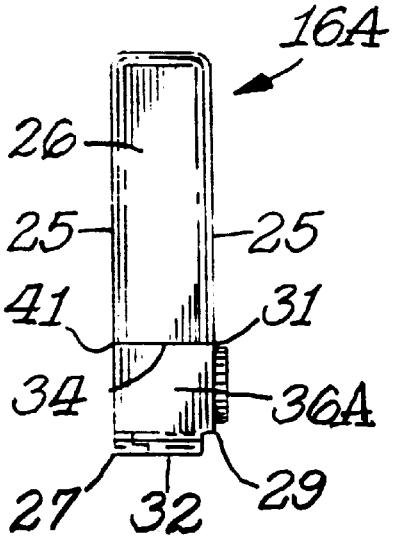
FIG. 7 is a front elevational view of the balance shoe shown in FIG. 6.

FIGS. 6–7 show a variation of the invention wherein the indented wall section 36A of balance shoe 16A occupies a greater portion of side wall 26. As shown therein, shoulder 34A is formed between location 31 inwardly from corner 29 and location 41 inwardly from corner 27. As illustrated, the shoulder 34A extends straight across wall 26 perpendicular to side edges 25,25 rather than being at the angle shown in FIG. 3. It is to be understood that the invention may be practiced where the location 41 is disposed even closer to or further from corner 27. Similarly, location 31 is not critical. What is important is that there should be an indented wall section to compensate for the possibility of flash.

What is claimed is:

1. In a window frame assembly made of hollow components welded together to form welded components having a channel with a weld seam in said channel and a balance shoe disposed in said channel for engagement with a pivot bar mounted to a frame member, the improvement being said balance shoe includes a housing having opposite side walls, said housing having a leading end and a trailing end, said leading end having a leading wall, said leading end being disposed in said channel at said weld seam, each of said side walls having a pair of opposite side edges forming a pair of corners at their junction with said leading wall, and one of said side walls being recessed at said leading end inwardly from said leading wall to comprise a recess in the form of an indented wall section extending substantially completely across said one of said side walls from each of said pair of corners and inwardly away from said leading wall and thereby accommodate a weld flash at said weld seam.

2. The assembly of claim 1 wherein said indented wall section includes a shoulder which is generally perpendicular to said side walls.

3. The assembly of claim 2 wherein said recess is located in each of said side walls.

4. The assembly of claim 3 wherein the weld flash is located at said weld seam.

5. The assembly of claim 1 wherein the weld flash is located at said weld seam.

6. A balance shoe for use in a pivotable window sash assembly having a frame with a track therein in which said balance shoe is adapted to be slidably mounted and having a window sash with a pivot bar mounted to the window sash for pivotal engagement with said balance shoe to connect the window sash and said balance shoe, said balance shoe comprising a housing having a pair of side walls and an interconnecting wall between said side walls for being disposed toward the pivot bar, each of said side walls having a front edge and a pair of opposite side edges forming a pair of corners at their junction with said front edge, an opening in said interconnecting wall, a locking member rotatably mounted in said opening of said interconnecting wall, and at least one of said side walls having a recess extending inwardly from said front edge of said at least one of said side walls to form an indented wall section extending substantially completely across said at least one of said side walls from each of said pair of corners of said at least one of said side walls and inwardly away from said front edge of said at least one of said side walls to thereby accommodate a weld flash in a weld seam formed by welding of frame components together.

7. The balance shoe of claim 6 wherein said indented wall section includes a shoulder which is generally perpendicular to said side walls.

8. The balance shoe of claim 7 wherein said recess is located in each of said side walls.

* * * * *